US006190785B1

(12) United States Patent
Yonezawa et al.

(10) Patent No.: US 6,190,785 B1
(45) Date of Patent: Feb. 20, 2001

(54) SPRAY COATING POWDER MATERIAL AND HIGH-TEMPERATURE COMPONENTS COATED THEREWITH

(75) Inventors: Toshio Yonezawa; Koji Fujimoto; Takashi Shige; Ikumasa Koshiro; Koji Takahashi, all of Takasago (JP)

(73) Assignee: Mitsubishi Heavy Industries, Ltd., Tokyo (JP)

( * ) Notice: Under 35 U.S.C. 154(b), the term of this patent shall be extended for 0 days.

(21) Appl. No.: 09/182,064

(22) Filed: Jan. 29, 1999

(30) Foreign Application Priority Data

Oct. 31, 1997 (JP) ..... 9-299816

(51) Int. Cl.[7] ..... C22C 19/07; C22C 38/06; C22C 38/18

(52) U.S. Cl. ..... 428/615; 75/255; 75/338; 75/351; 427/456; 427/123; 427/208.2; 427/229; 427/328; 427/376.8

(58) Field of Search ..... 75/255, 338, 351; 428/615; 427/456, 123, 208.2, 229, 328, 376.8

(56) References Cited

U.S. PATENT DOCUMENTS

| | | | |
|---|---|---|---|
| 4,101,713 | 7/1978 | Hirsch et al. | 428/554 |
| 5,116,690 | 5/1992 | Brindley et al. | 428/614 |

FOREIGN PATENT DOCUMENTS

| | | |
|---|---|---|
| 0 688 885 | 12/1995 | (EP) . |
| 10102227 | 4/1998 | (JP) . |

OTHER PUBLICATIONS

Koji: "Powder Material For Thermal Spraying Excellent In High Temperature Corrosion Resistance"; Patent Abstracts of Japan; Publication No. 10 102227; Publication Date: Apr. 21, 1998 vol. 098, No. 009; (Jul. 31, 1998).

*Primary Examiner*—Daniel J. Jenkins
(74) *Attorney, Agent, or Firm*—Foley & Lardner

(57) ABSTRACT

This invention relates to a spray coating powder material which, when applied to gas turbines using a crude low-quality fuel oil as fuel, has sufficiently higher corrosion resistance to sulfur, vanadium, sodium and other substances that accelerate corrosion in a high-temperature service environment, than conventional materials such as Ni-50 Cr and MCrAlY materials, as well as high-temperature components coated therewith. Specifically, this invention relates to a spray coating powder material comprising, on a weight percentage basis, greater than 45% and up to 60% of chromium, 5 to 15% of aluminum, 0.5 to 10% of zirconium, and the balance comprising cobalt or iron, or both, and incidental impurities, as well as high-temperature components coated therewith. This material can yield a sprayed coating having high corrosion resistance to sulfur, vanadium, sodium and other substances that accelerate corrosion in a high-temperature service environment.

15 Claims, 2 Drawing Sheets

SPRAY COATING POWDER MATERIAL AND HIGH-TEMPERATURE COMPONENTS COATED THEREWITH

BACKGROUND OF THE INVENTION

1. Field of the Invention

This invention relates to a spray coating powder material having excellent high-temperature corrosion resistance and hence suitable for use with moving and stationary blades of gas turbines, as well as high-temperature components coated therewith. Moreover, it also relates to a spray coating powder material having excellent high-temperature corrosion resistance and hence suitable for use with burner diffusers and other components for boilers, as well as high-temperature components coated therewith.

2. Description of the Related Art

Recently, the development of gas turbines using a low-quality fuel oil as fuel is being carried on from the viewpoint of resources saving, fuel cost reduction and the like. However, such low-quality fuel oils contain large amounts of constituents accelerating the corrosion of metals, such as sulfur, vanadium and sodium, so that moving and stationary blades which are high-temperature components of gas turbines are exposed to a very severe corrosive environment. In such an environment, base metals comprising conventional heat-resisting alloys and heat-resisting steel fail to show sufficient corrosion resistance and hence undergo accelerated deterioration with time. In the existing state of the art, therefore, the corrosion resistance of base metals comprising heat-resisting alloys and heat-resisting steel is secured by coating them with a powder material to a thickness of about 100–400 $\mu$m according to a plasma spraying technique. The power materials conventionally used for this purpose include, for example, Ni-50% Cr and MCrAlY materials (in which M represents Co, Ni, Fe or the like). that have been evaluated to have excellent corrosion resistance.

More recently, cruder low-quality fuel oils [for example, fuel oil C containing 10 to 30 mg/kg of sodium (Na), potassium (K) and vanadium (V)] have come to be used with a view to achieving a further reduction in fuel cost, and this exposes metallic components to a more corrosive environment. However, the aforesaid conventional Ni-50% Cr and MCrAlY materials fail to provide sufficient corrosion resistance and thereby function as a protective coating satisfactorily, so that the gas turbine shows a reduction in performance.

Under such circumstances, there is a demand for a spray coating powder material which can yield a sprayed coating having more excellent corrosion resistance and thermal shock resistance at high temperatures than those formed from conventional materials such as Ni-50% Cr and MCrAlY materials.

SUMMARY OF THE INVENTION

Accordingly, an object of the present invention is to provide a spray coating powder material which, when applied to gas turbines using a crude low-quality fuel oil as fuel, has sufficiently higher corrosion resistance to sulfur, vanadium, sodium and other substances that accelerate corrosion in a high-temperature service environment, than conventional materials such as Ni-50 Cr and MCrAlY materials, as well as high-temperature components coated therewith.

The present invention has been made for the purpose of accomplishing the above-described object, and its subject matter includes a spray coating powder material comprising, on a weight basis, greater than 45% and up to 60% of chromium, 5 to 15% of aluminum, 0.5 to 10% of zirconium, and the balance comprising cobalt or iron, or both, and incidental impurities, as well as high-temperature components coated therewith. This material can yield a sprayed coating having high corrosion resistance to sulfur, vanadium, sodium and other substances that accelerate corrosion in a high-temperature service environment.

Thus, the present invention makes it possible to obtain a spray coating powder material having excellent corrosion resistance at high temperatures and excellent corrosion resistance to sulfur, vanadium and sodium, as well as high-temperature components coated therewith.

DETAILED DESCRIPTION OF THE PREFERRED EMBODIMENTS

Figure 1:
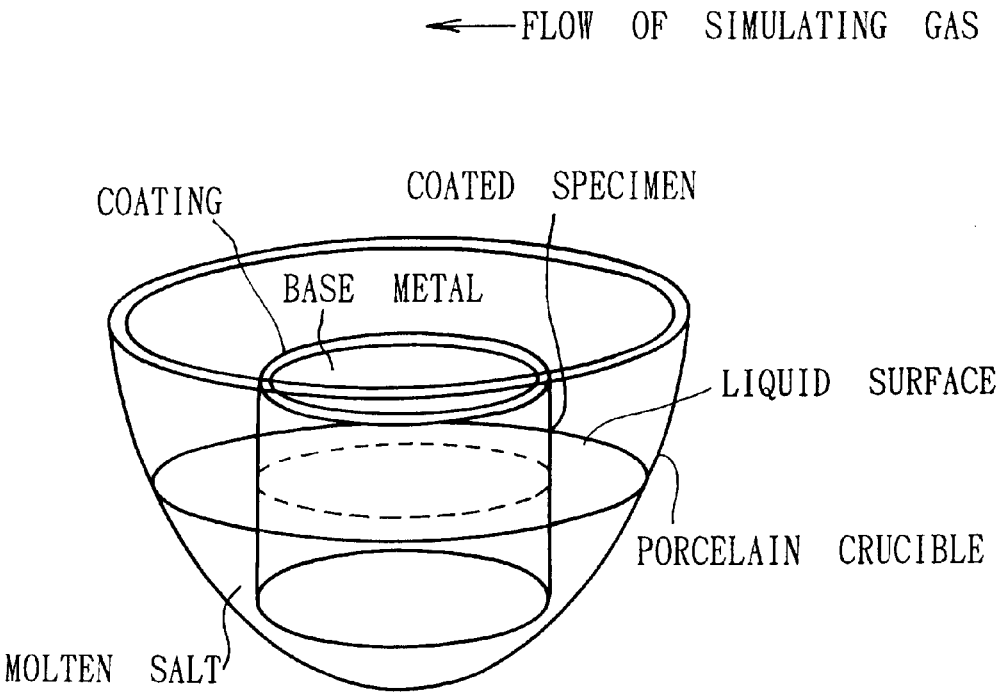
FIG. 1 is a schematic view of a high-temperature corrosion test apparatus.

In order to obtain a spray coating powder material having excellent high-temperature corrosion resistance to corrosion-accelerating substances such as sulfur, vanadium and sodium, the present inventors have defined its composition as described below.

Chromium (Cr), together with aluminum (Al), is an element which is indispensable for the purpose of maintaining high-temperature corrosion resistance. In a high-temperature corrosive environment, oxides of Cr and Al, or a compound oxide of Cr and Al, act as a protective coating and thereby improve corrosion resistance. Accordingly, corrosion resistance can be improved by increasing the content of Cr, but unduly high Cr contents in the material cause excessive precipitation of a phase and hence a reduction in ductility. Moreover, although a protective coating comprising an oxide of Cr is formed in the service environment, the coating may substantially lack ductility at Cr contents greater than 60% by weight, resulting in reduced thermal shock resistance at high temperatures. Thus, there is a possibility that cracking or separation of the coating may be promoted during use. If the Cr content is below a lower limit of 45% by weight, the problem of reduced thermal shock resistance may be eliminated, but a protective coating effective for securing corrosion resistance in a high-temperature corrosive environment may not be satisfactorily formed and, therefore, sufficient corrosion resistance may not be obtained. Consequently, the Cr content in the spray coating powder material should be more than 45% by weight and up to 60% by weight, and preferably in the range of 50 to 55% by weight from the viewpoint of corrosion resistance and thermal shock resistance.

As described above in connection with Cr, aluminum (Al) is also an element which is indispensable for the purpose of maintaining high-temperature corrosion resistance. In a high-temperature corrosive environment, oxides of Cr and Al, or a compound oxide of Cr and Al, act as a protective coating and thereby improve corrosion resistance. Accordingly, like Cr, corrosion resistance can be improved by increasing the content of Al, but unduly high Al contents in the material cause excessive precipitation of $\alpha$ phase and hence a reduction in ductility. Moreover, although a protective coating comprising an oxide of Al is formed in the service environment, the coating may substantially lack ductility at Cr contents greater than 15% by weight, resulting in reduced thermal shock resistance at high temperatures. Thus, there is a possibility that cracking or separation of the coating may be promoted during use. If the Al content is below a lower limit of 5% by weight, the problem of reduced thermal shock resistance may be eliminated, but a protective coating effective for securing corrosion resistance in a high-temperature corrosive environment may not be satisfactorily formed and, therefore, sufficient corrosion resistance may not be obtained. Consequently, the Al content in the spray coating powder material should be in the range of 5 to 15% by weight, and preferably in the range of 8 to 12% by weight from the viewpoint of corrosion resistance and thermal shock resistance.

On the other hand, zirconium (Zr) is characterized in that the free energy for the formation of its oxides is significantly low. Accordingly, when applied as a coating, Zr generally tends to form a very thin oxide film at low partial pressures of oxygen. Moreover, a $ZrO_2$ ceramic which is commonly known as an oxide of Zr has excellent corrosion resistance in the environment of interest. Thus, the formation of an oxide film of Zr brings about more excellent corrosion resistance, as compared with the corrosion resistance improved by the formation of an oxide film of Cr and Al alone. If the Zr content is greater than 10% by weight, the coating may lack ductility at high temperatures, resulting in reduced thermal shock resistance. Thus, there is a possibility that cracking or separation of the coating may be promoted during use. Moreover, at unduly high Zr contents, the portion of Zr which is insoluble in the matrix (i.e., in the interior of grains) tends to exist at grain boundaries. Thus, on the contrary, its segregation at grain boundaries decreases the contents of Cr and Al which are effective for securing corrosion resistance, so that the grain boundaries undergo selective corrosion and cause a reduction in corrosion resistance as a whole. If the Zr content is less than 0.5% by weight, an oxide film of Zr which is effective for securing corrosion resistance may not be satisfactorily formed and, therefore, the addition of Zr may not produce any beneficial effect. Consequently, the Zr content in the spray coating powder material should be in the range of 0.5 to 10% by weight, and preferably in the range of 1 to 5% by weight from the viewpoint of corrosion resistance improvement by the formation of an oxide film, and thermal shock resistance.

Furthermore, the balance comprises cobalt (Co) or iron (Fe), or both, and incidental impurities.

Co or Fe is an element which is important in forming a sprayed coating, and serves as an essential constituent for securing thermal resistance during long-term use at high temperatures. As compared with nickel (Ni), Co and Fe form much smaller amounts of sulfides in a corrosive environment, and hence exhibit excellent corrosion resistance in a high-temperature corrosive environment. A slight difference in corrosion resistance is observed according as the balance is based on Co or Fe. Although Fe can provide slightly higher corrosion resistance, the coating has lower ductility. Consequently, the balance should preferably be based on Co from the viewpoint of corrosion resistance and thermal shock resistance.

The term "incidental impurities" refers to elements which are introduced from raw materials at the stage of steel making and cannot be removed by refining. Specifically, they include P, S, O, Sn, As and Sb. The contents of incidental impurities as follows: P<0.03, S<0.03, O<0.01, Sn<0.01, As<0.01, and Sb<0.01. Since incidental impurities such as P and S cause a reduction in corrosion resistance, it is desirable to minimize their contents.

The spray coating powder material in accordance with the present invention may be prepared, for example, by melting a material having the above-described composition in a vacuum, and forming it into a powder material consisting of spherical particles according to a gas atomization technique (i.e., spraying in an atmosphere of argon gas). Moreover, there may also be employed other preparation methods such as sintering and casting methods.

The particle diameter of the spray coating powder material in accordance with the present invention needs to be suitably chosen according to the spraying technique, the thickness of the coating, and the like. In order to apply the powder material by low-pressure plasma spraying and thus form a sprayed coating having improved corrosion resistance as desired in the present invention, the average particle diameter thereof is preferably in the range of about 10 to 100 $\mu$m, though the present invention is not limited thereto. Moreover, it is preferable that the powder material consists of spherical particles formed by gas atomization of an alloy having the above-described chemical composition.

The present invention also provides high-temperature components coated with the spray coating powder material of the present invention. Although no particular limitation is placed on the base metal to be coated, high-temperature components having more excellent high-temperature corrosion resistance can be obtained by using a heat-resisting alloy or heat-resisting steel as the base metal. Specific examples of the base metal include ECY768 and IN738LC.

In order to improve the adhesion of the sprayed coating, it is preferable to subject the base metal to pretreatments such as cleaning (for stripping off any unnecessary oxide film) and surface roughening. The surface roughening may be carried out by blasting or the like.

In order to apply the spray coating powder material to the base metal, there may be employed coating techniques such as low-pressure plasma spraying, atmospheric plasma spraying, and high-speed oxygen flame spraying. Among others, low-pressure plasma spraying [for example, a process for spraying a material with the aid of a plasma flame in a low-pressure (e.g., about 6 kPa) atmosphere replaced by argon) is preferred.

The thickness of the sprayed coating should be determined with consideration for service conditions, desired corrosion resistance, and the like. For example, it is in the range of 100 to 1,000 $\mu$m.

After the spray coating powder material is applied, a diffusion heat treatment is carried out in order to improve the adhesion of the coating to the base metal. For example, this diffusion heat treatment may be carried out by placing the coated base metal in a vacuum furnace and heating it in an atmosphere of argon at a temperature of 1,100 to 1,200° C. for a period of 1 to 2 hours.

The present invention is more specifically explained with reference to the following examples. However, these examples are not to be construed to limit the scope of the present invention.

Materials having the respective chemical compositions shown in Table 1 (in which the symbol "Bal." shown in the columns for Co and Ni means the balance and includes incidental impurities) were provided. Each of these materials were melted in a vacuum and formed into a powder material consisting of spherical particles according to a gas atomization technique (i.e., spraying in an atmosphere of argon gas). This powder material was classified, and a fraction having a particle diameter range of 10 to 45 $\mu$m was used as a powder material for low-pressure plasma spraying.

In order to examine the characteristics of these spray coating powder materials, a heat-resisting Ni-base alloy (e.g., IN738LC) and a heat-resisting Co-base alloy (e.g., ECY768), which are in common use as base metals for moving and stationary blades of gas turbines, were employed as base metals for specimens. The chemical compositions of IN738LC and ECY768 selected as base metals are shown in Table 3.

The inventive materials were subjected to the following high-temperature corrosion tests, high-temperature thermal shock tests, and burner rig tests.

In order to prepare coated specimens for use in high-temperature corrosion tests, round bars (having a diameter of about 10 mm and a length of about 100 mm) made of IN738LC and ECY768, which are actually used materials for moving and stationary blades, were used as base metals. Using a metal blast prepared in the same manner as the spray coating powder material (i.e., prepared by melting a powder material having the same chemical composition as the base metal in a vacuum, spraying the melt in an atmosphere of argon gas to form it into spherical particles, and classifying them to obtain a fraction having a particle diameter range of about 100 to 300 $\mu$m), the aforesaid base metals in the form of round bars were blasted for several minutes in order to clean (i.e., strip off any unnecessary oxide film from) and roughen the surface layer of their outer periphery and thereby improve the adhesion of the sprayed coating. Thereafter, the pretreated base metals in the form of round bars were mounted in the vacuum chamber of a low-pressure plasma spraying apparatus, and their outer surfaces were coated with the powder materials having the respective chemical compositions shown in Table 1 by low-pressure plasma spraying under the conditions shown in Table 4. In low-pressure plasma spraying, the thickness of the coating was adjusted to 500–1,000 $\mu$m so that corrosion resistance might be maintained. Moreover, the coated specimens were placed in a vacuum furnace and heat-treated at 1,100–1,200° C. for 1–2 hours in order to improve the adhesion of the coating to the base metal by thermal diffusion. Thereafter, the specimens were cut into pieces having a length of about 20 mm and subjected to high-temperature corrosion tests by using a test apparatus illustrated in FIG. 1.

In order to prepare coated specimens for use in high-temperature thermal shock tests, round bars (having a diameter of about 10 mm and a length of about 65 mm) made of IN738LC and ECY768 were used as base metals, and the 30 mm long central part of each round bar was used for purposes of coating. Similarly to the above-described coated specimens for use in corrosion tests, the base metals were blasted, spray-coated with the powder materials having the respective chemical compositions shown in Table 1, heat-treated and then subjected to high-temperature thermal shock tests.

In order to evaluate thermal resistance and corrosion resistance in an actual service environment, burner rig tests were performed by using specimens having the shape of an actual blade. Specimens were prepared by forming base metals (i.e., IN738LC and ECY768) into the shape of an actual blade. Similarly to the above-described coated specimens for use in high-temperature corrosion tests and high-temperature thermal shock tests, the base metals were blasted, spray-coated with the powder materials having the respective chemical compositions shown in Table 1, heat-treated and then subjected to burner rig tests by using a test apparatus illustrated in FIG. 2.

In high-temperature corrosion tests, a coated specimen was soaked in a molten salt (composed of 60% by weight of $V_2O$ and 40% by weight of $Na_2SO_4$) held in a porcelain alumina crucible as illustrated in FIG. 1. This crucible was placed in an electric furnace and heated at 900° C. for 100 hours while a gas simulating combustion gas from an actual gas turbine was being passed therethrough. After completion of the test, the specimen was taken out and subjected to hot-water cleaning and acid cleaning (i.e., boiling for 1 hour in an aqueous solution containing 18% by weight of NaOH and 3% by weight of $KMnO_4$ and in an aqueous solution containing 10% by weight of ammonium citrate) to remove the molten salt attached to the coated part of the specimen. The weight loss by corrosion was determined by measuring the weight of the specimen before and after the test, and the loss in thickness due to corrosion was measured with a micrometer. Thus, the degrees of corrosion of various coating materials were evaluated. The target requirements were determined to be that the weight loss by corrosion and maximum loss in thickness after 100 hours of heating are not greater than 100 mg/cm$^2$ and not greater than 50 $\mu$m, respectively.

In high-temperature thermal shock tests, a coated specimen was rapidly heated to 990° C. in about 180 seconds and then cooled to 60° C. in about 240 seconds by blowing a cooling medium comprising alumina powder against the specimen. This test cycle was repeated, during which the coating was examined for the occurrence of cracking or separation due to thermal stresses. The maximum number of cycles was determined to be 1,000. This value was set so as to exceed the number of times at which the blades of an actual gas turbine are repeatedly started and stopped till the end of their service life. The target requirements were determined to be that the coated specimen can withstand the repetition of 1,000 cycles and the coating undergoes no cracking or separation.

Figure 2:
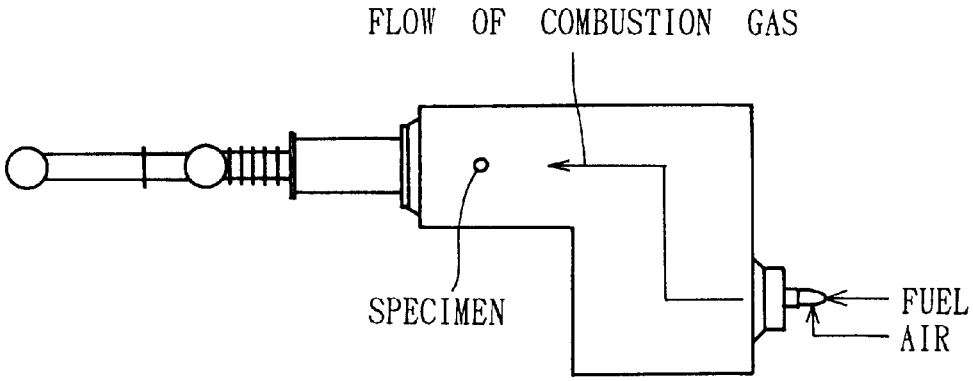
FIGS. 2(*a*) and 2(*b*) are a side view and a plan view, respectively, of a burner rig test apparatus.
Figure 2:
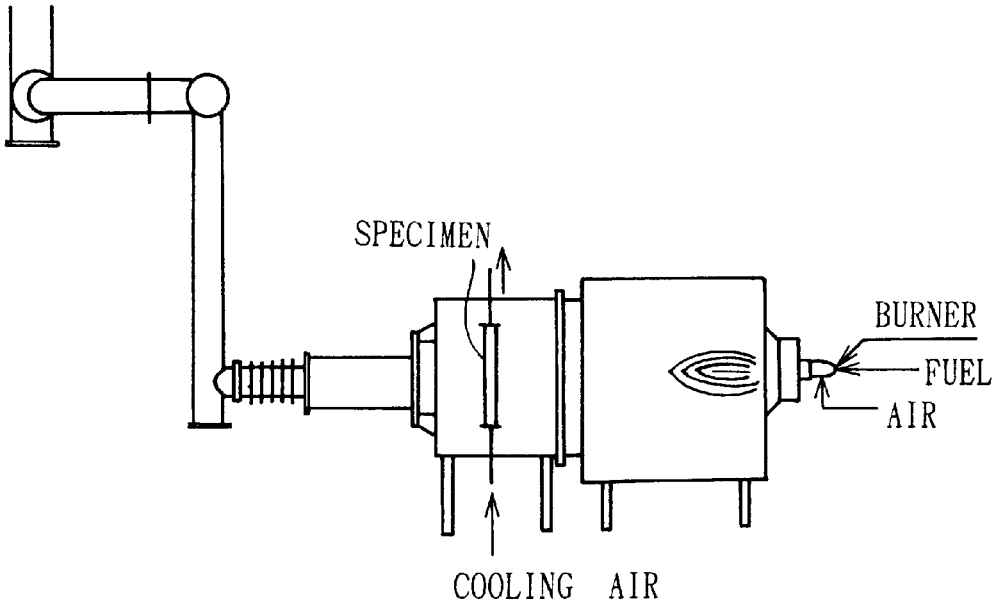

In burner rig tests, a test blade was held for 1 hour in an atmosphere of combustion gas resulting from the burning of a low-quality fuel oil (at a gas temperature of 1,250° C. and a metal temperature of 900° C.), and then cooled for 30 minutes, as illustrated in FIG. 2. This test cycle was repeated 50 times, so that the corrosion resistance and thermal shock resistance of the coating were evaluated under conditions based on actual service. After completion of the test, the specimen was subjected to hot-water cleaning and acid cleaning (i.e., boiling for 1 hour in an aqueous solution containing 18% by weight of NaOH and 3% by weight of $KMnO_4$ and in an aqueous solution containing 10% by weight of ammonium citrate) to remove the scale attached to the surface of the test blade. Thereafter, the weight loss of the test blade was determined, and the coating was examined for the occurrence of cracking or separation. The target requirements were determined to be that the test blade can withstand the repetition of 50 cycles and the weight loss thereof is not greater than 10 g.

The results of high-temperature corrosion tests, high-temperature thermal shock tests, and burner rig tests performed for the purpose of evaluating the characteristics of the coatings formed from the inventive materials are shown in Table 2. In this table, the results shown in the "High-temperature thermal shock test" column are based on visual inspection after up to 1,000 test cycles were repeated. In the "Evaluation" column of this table, open circles (○) indicate that all of the target requirements of these evaluation tests were satisfied, and crosses (×) indicate that at least one of the target requirements was not satisfied.

As shown in Table 2, the high-temperature corrosion tests revealed that the coated specimens prepared with spray coating powder materials having chemical compositions in accordance with the present invention had excellent corrosion resistance, as compared with the conventional materials and the comparative materials. Thus, the target requirements for weight loss by corrosion and maximum loss in thickness could be fully satisfied.

In the high-temperature thermal shock tests, similarly to the conventional materials, the inventive materials cleared the maximum number (1,000) of test cycles and remained intact without showing any cracking or separation of the coatings. In this case, assuming that the state of the coating showing no cracking or separation is set as a target requirement, the inventive materials could satisfy this target requirement.

Furthermore, in the burner rig tests, the inventive materials showed no cracking or separation of the coatings similarly to the conventional materials, and underwent a markedly lower degree of corrosion than the conventional materials. Thus, the target requirements could be fully satisfied.

In contrast to these results, the comparative materials and the conventional materials did not satisfy at least one of the target requirements of the above-described tests.

On the basis of the results of these tests, it may be said that the materials of the present invention have excellent corrosion resistance and thermal shock resistance at high temperatures.

TABLE 1

Chemical Compositions of Test Materials

| Test Material | | Chemical composition (wt %) | | | | | | |
|---|---|---|---|---|---|---|---|---|
| Division | Designation | Co | Fe | Ni | Cr | Al | Y | Zr |
| Inventive materials | 1 | Bal. | — | — | 46 | 10 | — | 3 |
| | 2 | Bal. | — | — | 50 | 10 | — | 3 |
| | 3 | Bal. | — | — | 52 | 10 | — | 3 |
| | 4 | Bal. | — | — | 55 | 10 | — | 1 |
| | 5 | Bal. | — | — | 60 | 10 | — | 1 |
| | 6 | Bal. | — | — | 52 | 5 | — | 1 |
| | 7 | Bal. | — | — | 52 | 12 | — | 1 |
| | 8 | Bal. | — | — | 52 | 15 | — | 1 |
| | 9 | Bal. | — | — | 52 | 10 | — | 0.5 |
| | 10 | Bal. | — | — | 52 | 10 | — | 1 |
| | 11 | Bal. | — | — | 52 | 10 | — | 5 |
| | 12 | Bal. | — | — | 52 | 8 | — | 8 |

TABLE 1-continued

Chemical Compositions of Test Materials

| Test Material | | Chemical composition (wt %) | | | | | | |
|---|---|---|---|---|---|---|---|---|
| Division | Designation | Co | Fe | Ni | Cr | Al | Y | Zr |
| | 13 | Bal. | — | — | 52 | 8 | — | 10 |
| | 14 | Bal. | — | — | 52 | 12 | — | 5 |
| | 15 | Bal. | — | — | 52 | 12 | — | 3 |
| | 16 | Bal. | — | — | 46 | 8 | — | 1 |
| | 17 | Bal. | — | — | 46 | 12 | — | 5 |
| | 18 | Bal. | — | — | 55 | 8 | — | 3 |
| | 19 | Bal. | — | — | 55 | 12 | — | 3 |
| | 20 | Bal. | — | — | 60 | 12 | — | 3 |
| | 21 | Bal. | — | — | 46 | 12 | — | 5 |
| | 22 | Bal. | — | — | 52 | 5 | — | 0.5 |
| | 23 | Bal. | — | — | 52 | 5 | — | 3 |
| | 24 | — | Bal. | — | 46 | 10 | — | 1 |
| | 25 | — | Bal. | — | 50 | 10 | — | 3 |
| | 26 | — | Bal. | — | 52 | 10 | — | 3 |
| | 27 | — | Bal. | — | 55 | 10 | — | 3 |
| | 28 | — | Bal. | — | 60 | 10 | — | 1 |
| | 29 | — | Bal. | — | 52 | 10 | — | 8 |
| | 30 | — | Bal. | — | 52 | 12 | — | 5 |
| | 31 | — | Bal. | — | 46 | 12 | — | 3 |
| | 32 | — | Bal. | — | 60 | 12 | — | 3 |
| | 33 | Bal. | 10 | — | 52 | 10 | — | 3 |
| | 34 | Bal. | 20 | — | 52 | 10 | — | 3 |
| | 35 | Bal. | 30 | — | 52 | 10 | — | 3 |
| Comparative materials | 36 | Bal. | — | — | 40 | 5 | — | 0.1 |
| | 37 | Bal. | — | — | 46 | 8 | — | 15 |
| | 38 | Bal. | — | — | 30 | 12 | — | 5 |
| | 39 | Bal. | — | — | 70 | 8 | — | 5 |
| | 40 | Bal. | — | — | 52 | 2 | — | 5 |
| | 41 | — | Bal. | — | 52 | 3 | — | 5 |
| | 42 | — | Bal. | — | 52 | 20 | — | 5 |
| | 43 | — | Bal. | — | 52 | 20 | — | 3 |
| | 44 | Bal. | 20 | — | 20 | 2 | — | 5 |
| | 45 | Bal. | 30 | — | 70 | 20 | — | 5 |
| Conventional materials | CoNiCrAlY | Bal. | — | 32 | 22 | 8 | 0.5 | — |
| | Ni—Cr | — | — | 50 | 50 | — | — | — |

TABLE 2

Test Results

| Test material | | Test results | | | | | |
|---|---|---|---|---|---|---|---|
| | | High-temperature corrosion test | | High-temperature thermal shock test | Burner rig test | | |
| Division | Designation | Weight loss by corrosion ($mg/cm^2$) | Maximum loss in thickness ($\mu m$) | Number of cycles till separation | Weight loss by corrosion (g) | Number of cycles till separation | Evaluation |
| Inventive materials | 1 | 83 | 40 | >1,000 | 9.3 | >50 | ○ |
| | 2 | 38 | 20 | >1,000 | 3.3 | >50 | ○ |
| | 3 | 25 | 10 | >1,000 | 1.5 | >50 | ○ |
| | 4 | 30 | 13 | >1,000 | 2.6 | >50 | ○ |
| | 5 | 45 | 28 | >1,000 | 5.0 | >50 | ○ |
| | 6 | 55 | 30 | >1,000 | 6.7 | >50 | ○ |
| | 7 | 50 | 32 | >1,000 | 6.3 | >50 | ○ |
| | 8 | 42 | 23 | >1,000 | 4.8 | >50 | ○ |

TABLE 2-continued

| Test Results | | | | | | | |
|---|---|---|---|---|---|---|---|
| | | Test results | | | | | |
| | | High-temperature corrosion test | | High-temperature thermal shock test | Burner rig test | | |
| Test material | | Weight loss by corrosion | Maximum loss in thickness | Number of cycles till separation | Weight loss by corrosion | Number of cycles till separation | |
| Division | Designation | (mg/cm$^2$) | ($\mu$m) | | (g) | | Evaluation |
| | 9 | 80 | 42 | >1,000 | 8.0 | >50 | ○ |
| | 10 | 30 | 16 | >1,000 | 2.0 | >50 | ○ |
| | 11 | 33 | 20 | >1,000 | 3.1 | >50 | ○ |
| | 12 | 73 | 37 | >1,000 | 7.8 | >50 | ○ |
| | 13 | 87 | 40 | >1,000 | 8.2 | >50 | ○ |
| | 14 | 40 | 20 | >1,000 | 3.7 | >50 | ○ |
| | 15 | 35 | 18 | >1,000 | 3.5 | >50 | ○ |
| | 16 | 85 | 45 | >1,000 | 9.2 | >50 | ○ |
| | 17 | 75 | 40 | >1,000 | 8.7 | >50 | ○ |
| | 18 | 50 | 27 | >1,000 | 6.1 | >50 | ○ |
| | 19 | 43 | 22 | >1,000 | 5.0 | >50 | ○ |
| | 20 | 55 | 25 | >1,000 | 6.5 | >50 | ○ |
| | 21 | 70 | 32 | >1,000 | 6.4 | >50 | ○ |
| | 22 | 85 | 38 | >1,000 | 9.4 | >50 | ○ |
| | 23 | 68 | 35 | >1,000 | 8.0 | >50 | ○ |
| | 24 | 80 | 40 | >1,000 | 9.6 | >50 | ○ |
| | 25 | 30 | 12 | >1,000 | 1.5 | >50 | ○ |
| | 26 | 32 | 18 | >1,000 | 1.8 | >50 | ○ |
| | 27 | 40 | 25 | >1,000 | 2.5 | >50 | ○ |
| | 28 | 73 | 38 | >1,000 | 6.9 | >50 | ○ |
| | 29 | 35 | 20 | >1,000 | 3.3 | >50 | ○ |
| | 30 | 38 | 17 | >1,000 | 3.5 | >50 | ○ |
| | 31 | 95 | 47 | >1,000 | 9.5 | >50 | ○ |
| | 32 | 75 | 30 | >1,000 | 8.7 | >50 | ○ |
| | 33 | 40 | 12 | >1,000 | 5.0 | >50 | ○ |
| | 34 | 42 | 15 | >1,000 | 5.5 | >50 | ○ |
| | 35 | 45 | 18 | >1,000 | 4.8 | >50 | ○ |
| Comparative materials | 36 | 165 | 95 | 250 | 2.5 | >50 | x |
| | 37 | 85 | 40 | >1,000 | 80 | 5 | x |
| | 38 | 205 | 100 | 250 | 30 | >50 | x |
| | 39 | 80 | 35 | 300 | 7.0 | 15 | x |
| | 40 | 158 | 80 | >1,000 | 20 | >50 | x |
| | 41 | 138 | 97 | >1,000 | 12 | >50 | x |
| | 42 | 75 | 30 | 450 | 10 | 35 | x |
| | 43 | 65 | 28 | 400 | 8.0 | 25 | x |
| | 44 | 225 | 95 | >1,000 | 35 | >50 | x |
| | 45 | 80 | 38 | 150 | 10 | 30 | x |
| Conventional materials | CoNiCrAlY | 325 | 92 | >1,000 | 50 | >50 | x |
| | Ni—Cr | 150 | 102 | >1,000 | 20 | >50 | x |

TABLE 3

| Chemical Compositions of Typical Base Metals | | | | | | | | | | | | | | |
|---|---|---|---|---|---|---|---|---|---|---|---|---|---|---|
| | Chemical compositions (%) | | | | | | | | | | | | | |
| Alloy | Co | Cr | Ni | Ti | W | Ta | C | Al | Zr | B | Fe | Si | Mn | S |
| ECY768 | Bal. | 23.5 | 9.86 | 0.22 | 7.18 | 3.75 | 0.61 | 0.21 | 0.01 | 0.001 | 0.06 | <0.10 | <0.10 | 0.001 |
| IN738LC | 8.30 | 15.9 | Bal. | 1.75 | 2.54 | 1.73 | 0.09 | 3.42 | 0.03 | 0.008 | 0.10 | <0.05 | <0.05 | <0.005 |

TABLE 4

Conditions for Low-Pressure Plasma Spraying

| Item | Division | Cleaning | Preheating | Spraying |
|---|---|---|---|---|
| Chamber | (mbar) | 30–40 | 45–55 | 55–65 |
| Spray distance | (mm) | 250–275 | 290–320 | 270–280 |
| Flow rate of Ar | (l/min) | 50–60 | 45–55 | 40–50 |
| Flow rate of $H_2$ | (l/min) | 0 | 7–9 | 8–10 |
| Current | (Amp) | 490–510 | 590–610 | 670–700 |
| Voltage | (V) | 58–62 | 60–65 | 62–67 |
| Powder feed | (%) | — | — | 12–16 |
| Transfer current | (A) | 45–55 | — | — |
| Flow rate of carrier gas | (l/min) | — | 1.8–2.0 | 1.8–2.0 |

What is claimed is:

1. A spray coating powder material having a chemical composition comprising, on a weight percentage basis, greater than 45% and up to 60% of chromium, 5 to 15% of aluminum, 0.5 to 10% of zirconium, and the balance comprising cobalt or iron, or both, and incidental impurities.

2. A high-temperature component coated with the spray coating powder material of claim 1.

3. A spray coating powder material according to claim 1, wherein the weight percentage of Cr is 50 to 55%.

4. A spray coating powder material according to claim 1, wherein the weight percentage of Al is 8 to 12%.

5. A spray coating powder material according to claim 1, wherein the weight percentage of Zr is 1 to 5%.

6. A spray coating powder material according to claim 1, wherein the incidental impurities are selected form the group consisting of P, S, O, Sn, As, Sb and mixtures thereof.

7. A spray coating powder material according to claim 1, wherein said material has a particle diameter of about 10 to 100 $\mu$m.

8. A high-temperature component according to claim 2, wherein the base metal of said coated components is selected from the group consisting of a heat-resistant alloy and a heat-resisting steel.

9. A high-temperature component according to claim 8, wherein said base metal is ECY768 or IN738LC.

10. A coated component according to claim 2, wherein said spray coating has a thickness in the range of 100 to 1,000 $\mu$m.

11. A process for the preparation of a spray coating powder material comprising:

subjecting to gas atomization a melted material having a chemical composition comprising, on a weight percentage basis, greater than 45% and up to 60% of chromium, 5 to 15% of aluminum, 0.5 to 10% of zirconium and the balance comprising cobalt or iron, or both and incidental impurities, to obtain a powder material.

12. A process for the preparation of a high-temperature component comprising:

cleaning and surface roughening a base metal of said component, applying to said base metal a spray coating powder material having a chemical composition comprising, on a weight percentage basis, greater than 45% and up to 60% of chromium, 5 to 15% of aluminum, 0.5 to 10% of zirconium and the balance comprising cobalt or iron, or both and incidental impurities, to obtain a coated base metal, and subjecting said coated base metal to a diffusion heat treatment, to obtain a coated high-temperature component.

13. A process for the preparation of a high-temperature component according to claim 12, wherein the spray coating powder material is applied by low pressure plasma spraying, atmospheric plasma spraying or high-speed oxygen flame spraying.

14. A process for the preparation of a high-temperature component according to claim 13, wherein the spray coating powder material is applied by low pressure plasma spraying.

15. A process for the preparation of a high-temperature component according to claim 12, wherein the diffusion heat treatment comprises heating the coated base metal in an atmosphere of argon, at a temperature of 1,100 to 1,200° C., for a period of 1 to 2 hours, in a vacuum furnace.

* * * * *